US010123633B2

(12) United States Patent
Laqua et al.

(10) Patent No.: US 10,123,633 B2
(45) Date of Patent: Nov. 13, 2018

(54) REFRIGERATED DISPLAY CASE

(71) Applicant: REMIS Gesellschaft fuer Entwicklung und Vertrieb von technischen Elementen mbH, Cologne (DE)

(72) Inventors: Ulrich Laqua, Wuppertal (DE); Ralf Toschek, Cologne (DE)

(73) Assignee: REMIS GESELLSCHAFT FUER ENTWICKLUNG UND VERTRIEB VON TECHNISCHEN ELEMENTEN MBH, Cologne (DE)

( * ) Notice: Subject to any disclaimer, the term of this patent is extended or adjusted under 35 U.S.C. 154(b) by 0 days.

(21) Appl. No.: 15/575,387

(22) PCT Filed: May 20, 2016

(86) PCT No.: PCT/EP2016/061486

§ 371 (c)(1),
(2) Date: Nov. 20, 2017

(87) PCT Pub. No.: WO2016/185036

PCT Pub. Date: Nov. 24, 2016

(65) Prior Publication Data

US 2018/0153314 A1 Jun. 7, 2018

(30) Foreign Application Priority Data

May 21, 2015 (EP) ..... 15168756

(51) Int. Cl.
*A47F 3/04* (2006.01)

(52) U.S. Cl.
CPC ..... *A47F 3/0469* (2013.01)

(58) Field of Classification Search
CPC ..... A47F 3/04169; A47F 3/04; F25D 23/02; F25D 23/023
See application file for complete search history.

(56) References Cited

U.S. PATENT DOCUMENTS 4,288,992 A * 9/1981 Eliason ..... E06B 3/80 62/256
5,171,076 A * 12/1992 Eming ..... A47F 3/0469 160/66

FOREIGN PATENT DOCUMENTS

EP 0 015 411 A1 9/1980
GB 2 069 675 A 8/1981

* cited by examiner

*Primary Examiner* — Elizabeth Martin
(74) *Attorney, Agent, or Firm* — Norman B. Thot

(57) ABSTRACT

A refrigerated shelf unit includes a housing, shelves arranged stair-like within the housing, an access opening arranged in the housing, and a night time cover assembly which closes the access opening. The night time cover assembly includes a shutter tube fastened to the housing, an insulating film with an upper end fixed to the shutter tube and a lower end, a tensioning rail arranged at the lower end of the insulating film, and a pivot arm. The insulating film is rolled on the shutter tube when the night time cover assembly is open and is rolled off the shutter tube to span the access opening when the night time cover assembly is closed. An upper and lower end of the pivot arm are hinged to hinges which are inclined so that a pivot plane of the pivot arm is inclined by 10° to 70° with respect to a vertical plane.

6 Claims, 5 Drawing Sheets

REFRIGERATED DISPLAY CASE

CROSS REFERENCE TO PRIOR APPLICATIONS

This application is a U.S. National Phase application under 35 U.S.C. § 371 of International Application No. PCT/EP2016/061486, filed on May 20, 2016 and which claims benefit to European Patent Application No. 15168756.3, filed on May 21, 2015. The International Application was published in German on Nov. 24, 2016 as WO 2016/185036 A1 under PCT Article 21(2).

FIELD

The present invention relates to a refrigerated shelf unit with a plurality of shelves arranged in a stair-like manner in a refrigerated shelf unit housing, the depth of the shelves increasing from top to bottom.

BACKGROUND

The term "refrigerated shelf unit" as used herein in particular relates to a commercial refrigerated shelf unit that may be configured as a freezing or a non-freezing refrigerated shelf unit, and which in particular serves to store and display food products in food markets. The refrigerated shelf unit comprises a refrigerated shelf unit housing with an inclined access opening, the opening plane of the access opening approximately following the inclination of the front edges of the shelves arranged in a stair-like manner. The inclination of the opening plane with respect to the vertical plane does not, however, necessarily have to exactly correspond to the imaginary line connecting the front edges of the shelves. Such refrigerated shelf units are either operated in an open state during selling times, or they have transparent doors, in particular sliding doors, which may be arranged to be slid in a lateral direction approximately in the opening plane.

For closing the access opening during non-selling times, so-called "night time cover assemblies" are moved into their closed state to reduce convective heat losses and radiation losses. For example, shutter assemblies are used as night time cover assemblies, which are formed by a shutter tube on which a flexible insulating film is rolled in the open state of the night time cover assembly, which is spanned in front of the access opening in the closed state. Since the opening plane of the access opening is inclined, however, both side edges of the insulating film are guided in corresponding guides which block the view to the shelves, as well as the access thereto.

SUMMARY

An aspect of the present invention is to provide a refrigerated shelf unit with a night time cover assembly and a night time cover assembly for a refrigerated shelf unit with a plurality shelves arranged in a stair-like manner that allows for an unobstructed view of the shelves.

In an embodiment, the present invention provides a refrigerated shelf unit which includes a refrigerated shelf unit housing, a plurality of shelves arranged within the refrigerated shelf unit housing in a stair-like manner, an access opening arranged in the refrigerated shelf unit housing, and a night time cover assembly configured to close the access opening. The access opening comprises an upper edge and an opening plane which is inclined by 10° to 70° with respect to a vertical plane. The night time cover assembly comprises a shutter tube associated with the upper edge of the access opening, a flexible insulating film, a horizontal tensioning rail, and at least one pivot arm. The shutter tube is fastened to the refrigerated shelf unit housing. The flexible insulating film comprises an upper end which is fixed to the shutter tube and a lower end. The flexible insulating film is configured to be rolled on and off the shutter tube so that, when the night time cover assembly is in an open state, the flexible insulating film is rolled on the shutter tube and, when the night time cover assembly is in a closed state, the flexible insulating film is rolled off the shutter tube so as to be spanned in the access opening. The horizontal tensioning rail is arranged at the lower end of the flexible insulating film. The at least one pivot arm comprises an upper longitudinal end hinged at a housing-side pivot hinge and a lower longitudinal end hinged at a tensioning rail-side holding hinge. The housing-side pivot hinge and the tensioning rail-side holding hinge are inclined so that a pivot plane of the at least one pivot arm corresponds to the opening plane and is inclined by 10° to 70° with respect to the vertical plane.

BRIEF DESCRIPTION OF THE DRAWINGS

The present invention is described in greater detail below on the basis of embodiments and of the drawings in which.

DETAILED DESCRIPTION

Figure 1:
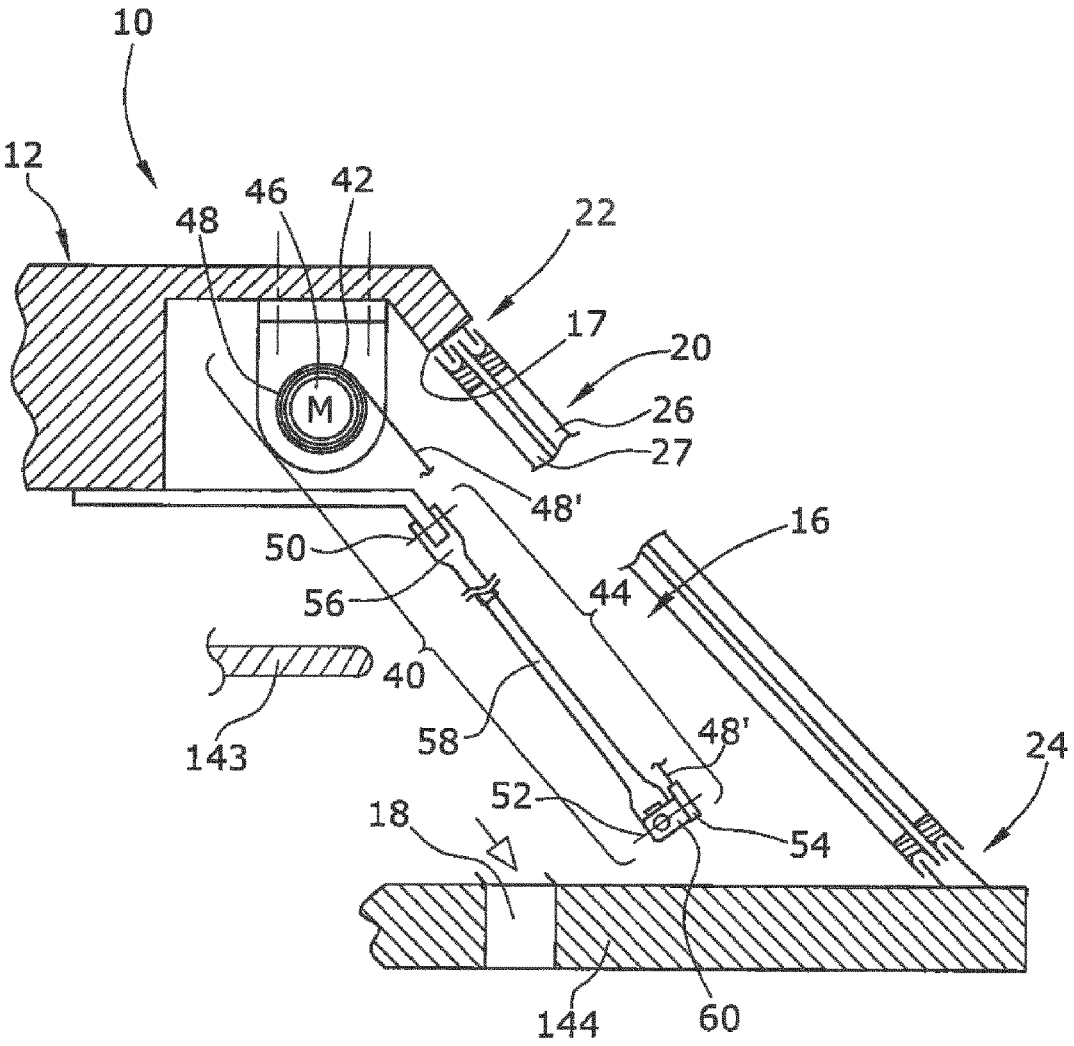
FIG. 1 shows a cross section of a detail of a refrigerated shelf unit according to the present invention with a door assembly and a night time cover assembly.

The refrigerated shelf unit of the present invention comprises a night time cover assembly in which lateral guide rails for guiding the flexible insulating film are omitted altogether. The night time cover assembly comprises a shutter tube which can, for example, be driven by an electric drive motor. The shutter tube is associated to an upper opening edge of the access opening and is mounted to the refrigerated shelf unit housing in the region of the upper opening edge of the access opening. A flexible insulating film is further provided, the upper end of which is fixed to the shutter tube and which, in the open state of the night time cover assembly, is rolled on the shutter tube. In the closed state of the night time cover assembly, the insulating film is rolled at least partly from the shutter tube, and is spanned in the region of the access opening. A horizontal tensioning rail is further provided and fastened at the lower end of the insulating film, the rail being rigid. The lower longitudinal edge of the insulating film can, for example, be clamped firmly therein.

The night time cover assembly has at least one pivot arm whose upper longitudinal end is hinged at a housing-side pivot hinge. The lower longitudinal end of the pivot arm is pivotably hinged at a holding hinge that is fixed to the tensioning rail. Both hinges are inclined so that the pivoting plane of the pivot arm corresponds to the opening plane and is inclined by at least 10° and at most 70° with respect to the vertical earth plane. The term "corresponding" as currently used does not necessarily mean a congruence of the respective inclination with the vertical earth plane. For example, a deviation of 10° to 20° between the two planes is still considered as "corresponding" as used herein. The night time cover obstructs a view of the shelves arranged in a stair-like manner in the closed state.

By using the night time cover assembly of the present invention, the flexible insulation film is thus spanned in an inclined orientation in front of the shelves when in the closed state. Radiation losses are thereby in particular significantly reduced. Convective losses are also significantly reduced thereby in a refrigerated shelf unit without a door.

The pivot arm causes the insulating film to be spanned in the region of the access opening in a plane inclined with respect to the vertical plane without lateral guides for the lateral edges of the insulating film being required. Since the lateral guides are omitted, an unobstructed view and access to the goods on the shelves is possible in the open state of the assembly.

In an embodiment, the night time cover assembly can, for example, be arranged on the inner side of the access opening so that, in the closed state of the assembly, the wound-up insulating film closes the access opening from the inner side. The closer the insulating film is arranged to the shelves in the closed state, the better the insulating effect of the insulating film is.

In an embodiment, the pivot arm can, for example, be arranged on the inner side of the insulating film. The pivot arm thereby additionally provides mechanical support to the insulating film spanned in the closed state.

In an embodiment, a separate transparent door assembly, fastened to the refrigerated shelf unit housing, can, for example, be arranged in the access opening, the night time cover assembly being arranged inward of the door assembly. A transparent door assembly is meant to refer to a door assembly with doors having transparent panes through which the shelves or the goods on the shelves are visible from outside. A transparent door assembly is, however, more or less permeable to thermal radiation. Radiation losses are also significantly reduced due to the fact that the insulating film is spanned inward of the door assembly in the closed state of the night time cover assembly.

The pivot arm can basically be configured as an articulated arm. In an embodiment, the pivot arm can, for example, be configured as a telescopic arm and respectively has at least two telescopable telescopic bars. The telescopic arm may be biased in the opening direction, for example, by an integrated gas spring.

In an embodiment, the refrigerated shelf unit provided with a convection cooling can, for example, have a cooling air opening inward of the lower edge of the access opening. The night time cover assembly is arranged so that, in the closed state of the night time cover assembly, the cooling air opening is situated inward of the lower longitudinal edge of the insulating foil. The cooling air flow is thereby not or only minimally disturbed in a refrigerated shelf unit with convection cooling.

In an embodiment, the insulating film can, for example, have no heat-reflecting coating, but is a flexible plastic material sheet having a thickness of more than 2.0 mm. Such an insulating film has good thermal insulation properties so that, at least in a refrigerator for temperatures above the freezing point, condensation on the insulating film can be excluded.

In an embodiment, a night time cover assembly for a refrigerated shelf unit can, for example, be provided, wherein the refrigerated shelf unit has features which relate to the refrigerated shelf unit housing. The night time cover assembly has the features which relate to the night time cover assembly.

An embodiment of the present invention will be explained in detail below under reference to the drawings.

Figure 2:
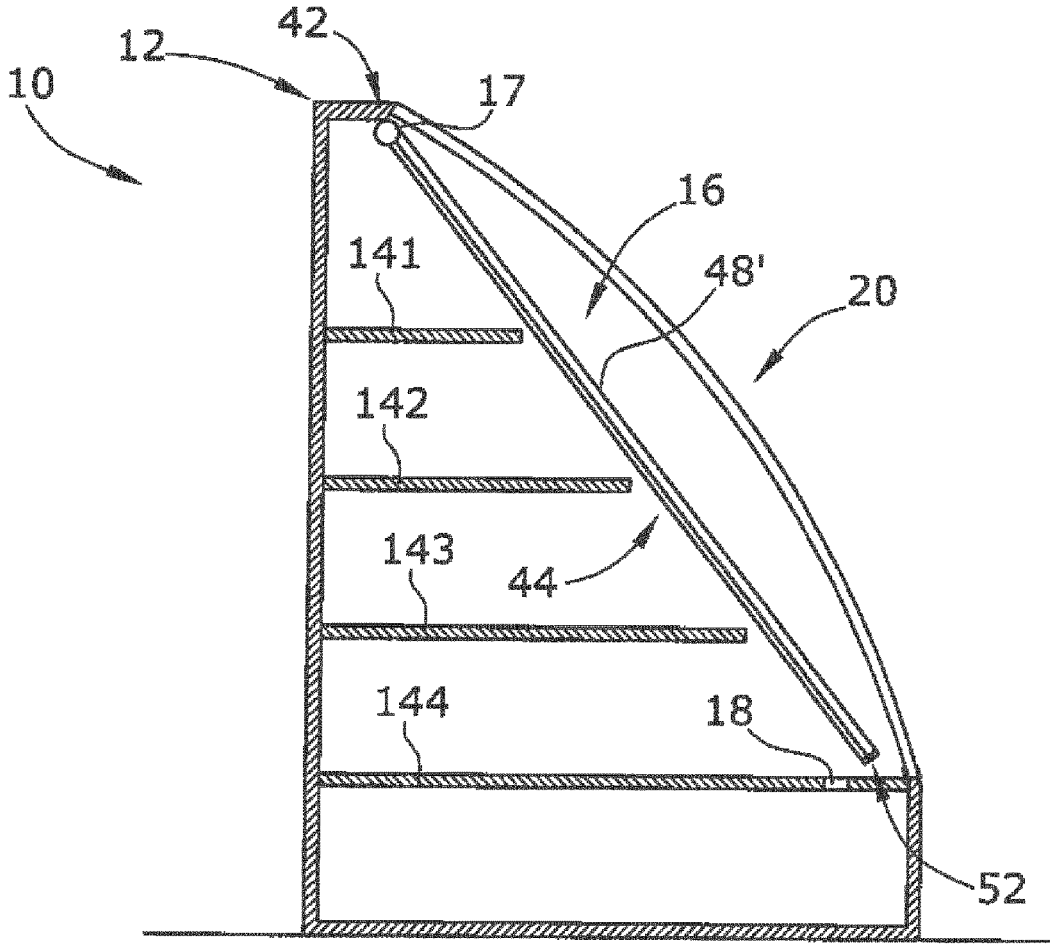
FIG. 2 shows a cross section of the entire refrigerated shelf unit in FIG. 1 with the night time cover assembly in the closed state.
Figure 3:
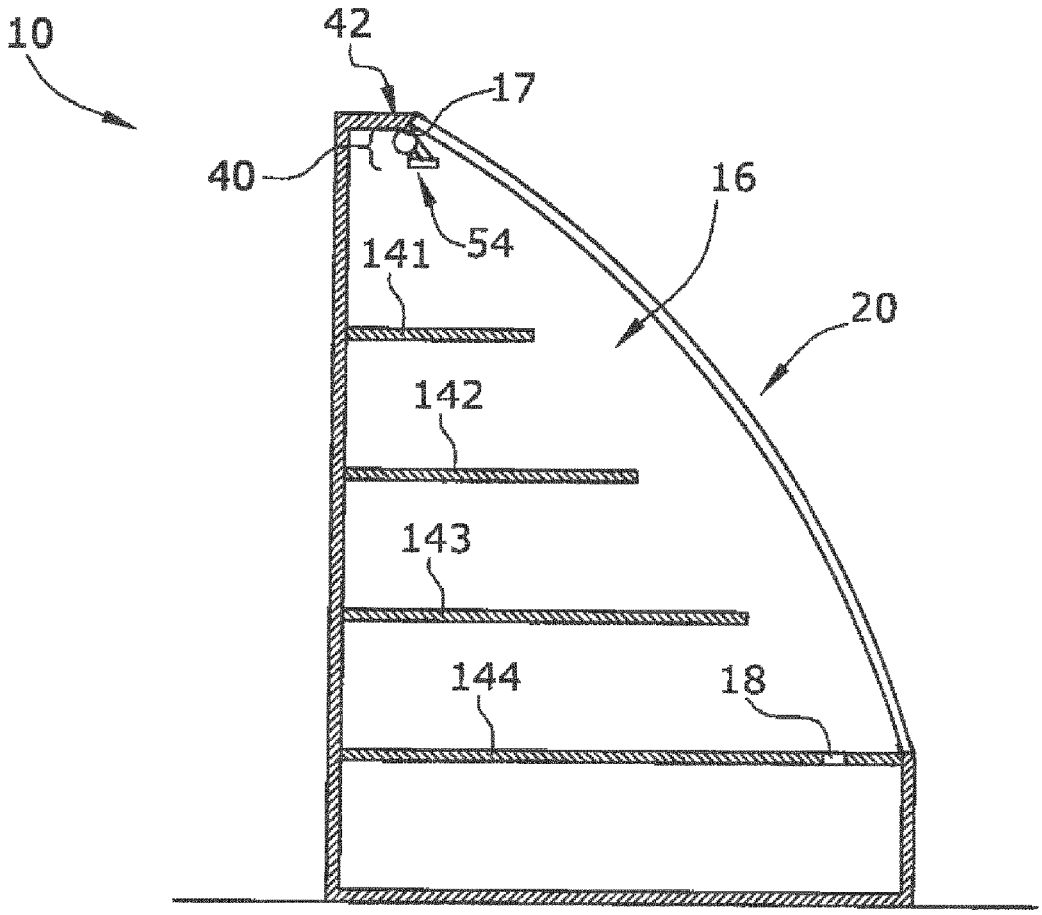
FIG. 3 shows a cross section of the refrigerated shelf unit in FIG. 2 with the night time cover assembly in the open state.
Figure 4:
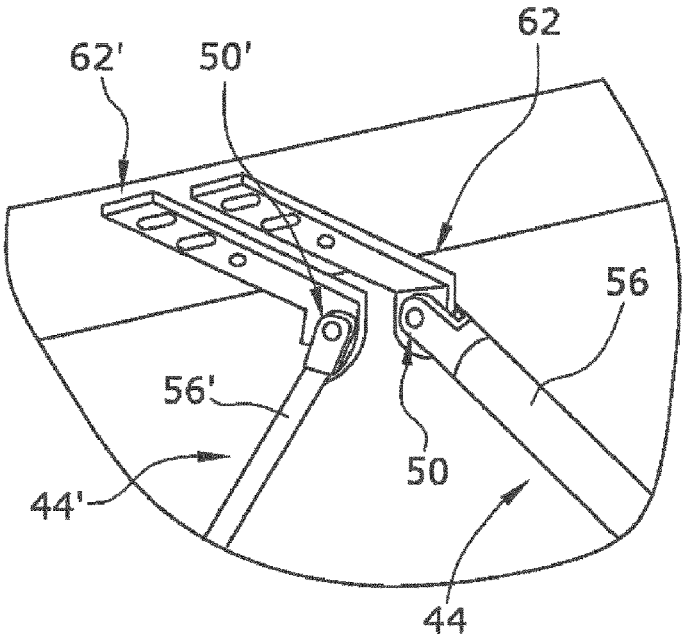
FIG. 4 shows an enlarged illustration of a housing-side pivot hinge of the night time cover assembly of the refrigerated shelf unit in FIGS. 1 to 3.
Figure 5:
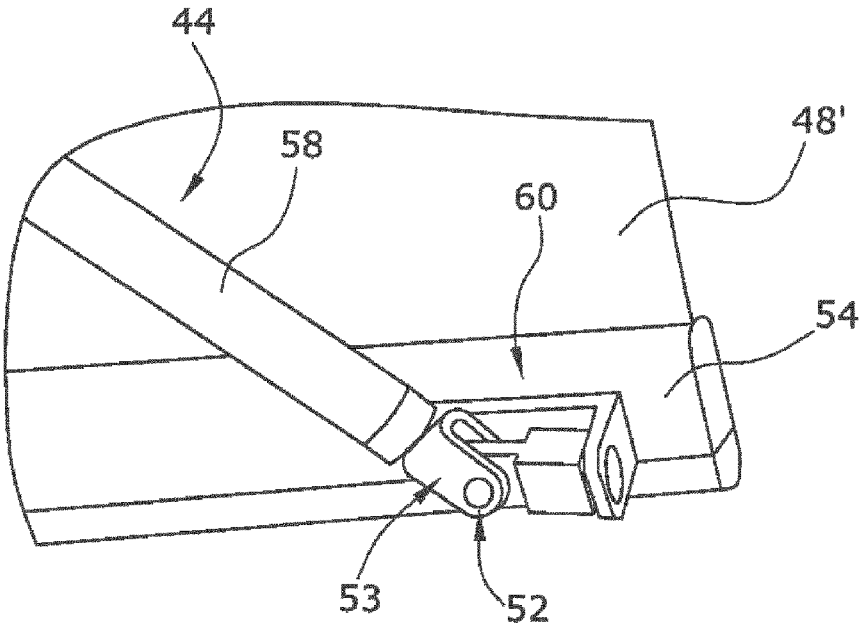
FIG. 5 shows an enlarged illustration of a tensioning rail-side holding hinge of the night time cover assembly of the refrigerated shelf unit in FIGS. 1 to 3.
Figure 6:
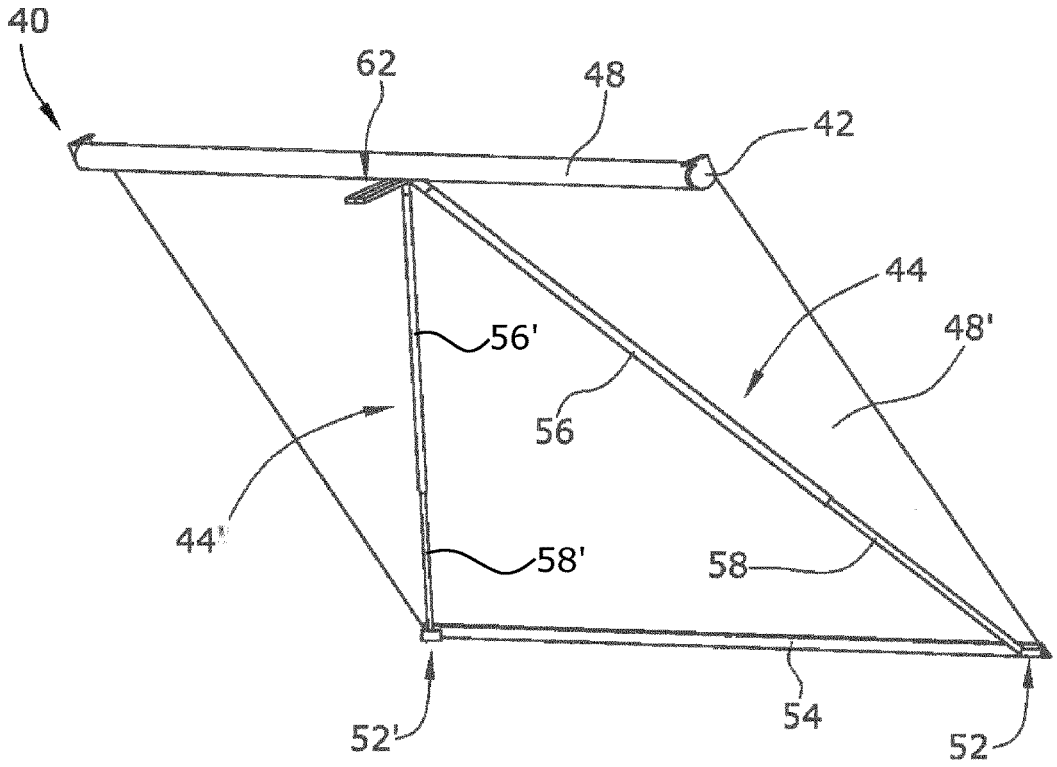
FIG. 6 shows the night time cover assembly of the refrigerated shelf unit in FIGS. 1 to 3 in the closed state.
Figure 7:
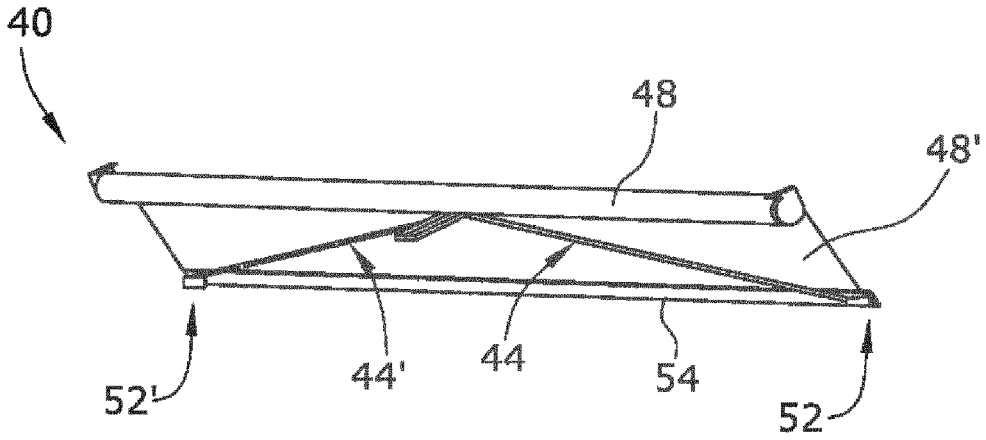
FIG. 7 shows the night time cover assembly in FIG. 6 in the open state.

FIGS. 1 to 3 respectively show a refrigerated shelf unit 10 which serves to refrigerate and display food products in cross section. It is a refrigerated shelf unit for refrigeration above 0° C., not a deep-freezing shelf unit. The refrigerated shelf unit 10 has a static stable refrigerated shelf unit housing 12 with a plurality of shelves 141 to 144 arranged therein in a stair-like manner. The stair-like character of the arrangement of the shelves 141 to 144 is achieved by the fact that the lower of the shelves 141 to 144 respectively protrude further to the front than the upper of the shelves 141 to 144 arranged above, as can be seen in FIGS. 2 and 3.

The refrigerated shelf unit housing 12 has an access opening 16 whose opening plane is inclined, in the present instance, by approximately 30°, with respect to the vertical plane. The inclination of the opening plane of the access opening 16 approximately corresponds to the stair inclination of the stair-like envelope formed by the shelves 141 to 144. A cooling air opening 18 is provided in the bottom wall or the bottom shelf 144 of the refrigerated shelf unit housing 12 through which cooling air can flow in or out.

The refrigerated shelf unit 10 has a transparent door assembly 20 in the region of the access opening 16 which is formed substantially by a set of transparent sliding doors 26, 27 guided in an upper door guide 22 at the upper opening edge 17 of the access opening 16 and in a lower door guide 24 at the lower opening edge of the access opening 16.

A night time cover assembly 40 is further provided in the region of the access opening 16 for closing the access opening 16 if so desired. The night time cover assembly 40 includes an electrically driven shutter tube 42 which is fastened to the refrigerated shelf unit housing 12 in the region of the upper opening edge 17 of the access opening 16. The shutter tube 42 is cylindrical and is driven by a drive motor 46 configured as a tube motor. A flexible insulating film 48 is wound on the horizontally mounted shutter tube 42, the upper longitudinal end of which is fixed to the shutter tube 42. In the open sate of the night time cover assembly 40 illustrated in FIGS. 1 and 2, the insulating film 48' is rolled off the shutter tube 42 for the greater part or completely.

The night time cover assembly 40 further has a horizontal tensioning rail 54 at the lower longitudinal end of the insulating film 48, 48'. Two pivot arms 44, 44' are also provided whose upper longitudinal ends are respectively hinged to an upper housing-side pivot hinge 50, 50' and whose lower longitudinal ends are respectively hinged to a tensioning rail-side holding hinge 52. The upper housing-side pivot hinges 50, 50' are inclined approximately so that the pivot plane of the two pivot arms 44, 44' is always inclined by about 30° with respect to the vertical earth plane.

The upper housing-side pivot hinges 50, 50' are formed by a housing-side hinge fitting 62, 62' to which an upper pivot arm claw 51 of the pivot arm 44 is pivotably fastened. The lower tensioning rail-side holding hinges 52, 52' are formed by a corresponding tensioning rail-side hinge fitting 60 at which a respective lower pivot arm claw 53 of the pivot arm 44, 44' is pivotably fastened.

The pivot arms 44, 44' are each designed as telescopic arms and each comprise two telescopable telescopic bars 56, 58 and 56', 58'. In the pivot arms 44, 44', a respective gas spring, designed as a compression spring, may be provided which biases the pivot arm pneumatically.

The present invention is not limited to embodiments described herein; reference should be had to the appended claims.

What is claimed is:

1. A refrigerated shelf unit comprising:
- a refrigerated shelf unit housing;
- a plurality of shelves arranged within the refrigerated shelf unit housing in a stair-like manner;
- an access opening arranged in the refrigerated shelf unit housing, the access opening comprising an upper edge and an opening plane which is inclined by 10° to 70° with respect to a vertical plane;
- a night time cover assembly configured to close the access opening, the night time cover assembly comprising:
  - a shutter tube associated with the upper edge of the access opening, the shutter tube being fastened to the refrigerated shelf unit housing,
  - a flexible insulating film comprising an upper end which is fixed to the shutter tube and a lower end, the flexible insulating film being configured to be rolled on and off the shutter tube so that, when the night time cover assembly is in an open state, the flexible insulating film is rolled on the shutter tube and, when the night time cover assembly is in a closed state, the flexible insulating film is rolled off the shutter tube so as to be spanned in the access opening,
  - a horizontal tensioning rail arranged at the lower end of the flexible insulating film,
  - a housing-side pivot hinge,
  - a tensioning rail-side holding hinge, and
  - at least one pivot arm comprising an upper longitudinal end hinged at the housing-side pivot hinge and a lower longitudinal end hinged at the tensioning rail-side holding hinge,
  - wherein,
  - the housing-side pivot hinge and the tensioning rail-side holding hinge are inclined so that a pivot plane of the at least one pivot arm corresponds to the opening plane and is inclined by 10° to 70° with respect to the vertical plane, and
  - the at least one pivot arm is provided as a telescopic arm which comprises at least two telescopable telescopic bars.

2. The refrigerated shelf unit as recited in claim 1, wherein the night time cover assembly is arranged inward of the access opening so that, in the closed state, the flexible insulating film, when rolled off, closes the access opening from an inner side.

3. The refrigerated shelf unit as recited in claim 1, wherein the at least one pivot arm is arranged inward of the flexible insulating film.

4. The refrigerated shelf unit as recited in claim 1, further comprising:
- a transparent door assembly arranged in the access opening and being fastened at the refrigerated shelf unit housing,
- wherein,
- the night time cover assembly is arranged inward of the transparent door assembly.

5. The refrigerated shelf unit as recited in claim 1, further comprising:
- a cooling air opening,
- wherein,
- the access opening further comprising a lower edge,
- the cooling air opening is arranged inward of the lower edge of the access opening, and
- the night time cover assembly is arranged outward of the cooling air opening when in the closed state.

6. A night time cover assembly for a refrigerated shelf unit,
- the refrigerated shelf unit comprising:
  - a refrigerated shelf unit housing;
  - a plurality of shelves arranged within the refrigerated shelf unit housing in a stair-like manner; and
  - an access opening arranged in the refrigerated shelf unit housing, the access opening comprising an upper edge and an opening plane which is inclined by 10° to 70° with respect to a vertical plane;
- the night time cover assembly comprising:
  - a shutter tube associated with the upper edge of the access opening, the shutter tube being fastened to the refrigerated shelf unit housing;
  - a flexible insulating film comprising an upper end which is fixed to the shutter tube and a lower end, the flexible insulating film being configured to be rolled on and off the shutter tube so that, when the night time cover assembly is in an open state, the flexible insulating film is rolled on the shutter tube and, when the night time cover assembly is in a closed state, the flexible insulating film is rolled off the shutter tube so as to be spanned in the access opening;
  - a horizontal tensioning rail arranged at the lower end of the flexible insulating film;
  - a housing-side pivot hinge;
  - a tensioning rail-side holding hinge;
  - at least one pivot arm comprising an upper longitudinal end hinged at the housing-side pivot hinge and a lower longitudinal end hinged at the tensioning rail-side holding hinge;
  - wherein,
  - the housing-side pivot hinge and the tensioning rail-side holding hinge are inclined so that a pivot plane of the at least one pivot arm corresponds to the opening plane and is inclined by 10° to 70° with respect to the vertical plane, and
  - the at least one pivot arm is provided as a telescopic arm which comprises at least two telescopable telescopic bars.

* * * * *